United States Patent [19]

Caughey

[11] 4,258,476

[45] Mar. 31, 1981

[54] DRYER FOR PARTICULATE MATERIAL

[75] Inventor: Robert A. Caughey, Antrim, N.H.

[73] Assignee: Forest Fuels, Inc., Keene, N.H.

[21] Appl. No.: 51,952

[22] Filed: Jun. 25, 1979

[51] Int. Cl.[3] ..... F26B 17/12

[52] U.S. Cl. ..... 34/174

[58] Field of Search ..... 34/19, 22, 25, 33, 34, 34/35, 56, 85, 86, 90, 164, 168, 174, 175, 182, 231, 233; 110/224, 227, 293; 432/134

[56] References Cited

U.S. PATENT DOCUMENTS

| | | | |
|---|---|---|---|
| 1,482,812 | 2/1924 | Roberts | 34/174 |
| 1,718,243 | 6/1929 | Lindhard | 34/174 |
| 1,787,878 | 1/1931 | Warden-Stevens | 34/174 |
| 2,371,095 | 3/1945 | Woodward | 34/174 |
| 3,000,110 | 9/1961 | Furth et. al. | 34/174 |
| 3,169,051 | 2/1965 | Müll | 34/174 |

FOREIGN PATENT DOCUMENTS

| | | | |
|---|---|---|---|
| 88453 | 12/1952 | Denmark | 34/174 |

*Primary Examiner*—Albert J. Makay

*Assistant Examiner*—Harold Joyce

*Attorney, Agent, or Firm*—Robert T. Gammons

[57] ABSTRACT

A dryer for particulate material, especially wood chips, to render them suitable for burning comprising an enclosure, spaced baffle plates in the enclosure dividing the enclosure from bottom to top into three chambers; an intermediate drying chamber for holding a column of particulate material for drying and two air chambers, one on each side of the drying chamber. The baffles contain openings, the air chamber at one side contains a bottom opening through which drying air is supplied to the enclosure and the air chamber at the other side contains an opening at the top through which moist air is discharged from the enclosure. There is a conveyor at the upper end of the enclosure for supplying particulate material to the upper end of the drying chamber, a discharge opening at the bottom of the enclosure for permitting discharge of the particulate material from the lower end of the drying chamber and an oscillator for at times effecting oscillation of the baffle plates to, in turn, effect discharge of particulate material through the bottom opening.

4 Claims, 2 Drawing Figures

DRYER FOR PARTICULATE MATERIAL

BACKGROUND OF THE INVENTION

Figure 1:
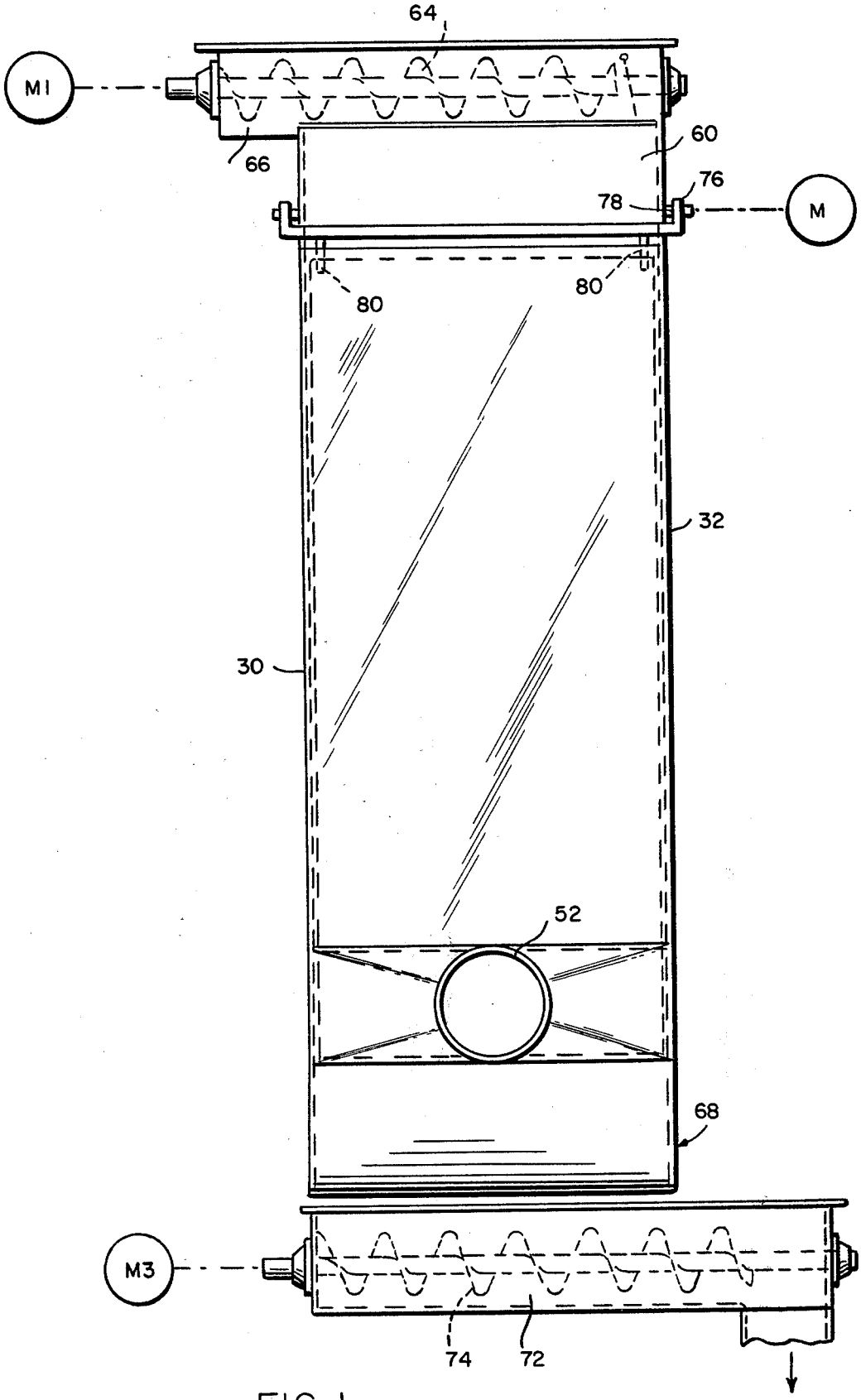

One of the inherent problems in the burning of wood products is that for efficient burning, the moisture content should be reduced as low as possible, preferably below 10%. The major potential source of wood fuel is pulp chips, although considerable amounts of shavings and sawdust are available from the lumber industry. This material may contain as much as 50% water, sometimes more, most of which should be removed before burning.

Conventionally, more finely divided materials may be dried in a rotary drum dryer, where the particles are suspended in hot air as they pass through the dryer. This is feasible with small or thin particles, because the time of retention in the dryer is very short. However, as the particles become larger, retention time must be greatly increased because of the low thermal conductivity of the wood. In drying a piece of wood, it is necessary to provide all the heat for evaporation of the water by transfer of the heat from the surface of the particles to the center of the particles. This requires that the whole particle must be heated beyond vaporizing temperature, as sufficient time must be allowed for the transfer of the heat to the center of the particle and for the diffusion of the water vapor to the surface of the particle. Thus, as the particle becomes larger, the retention time for drying at a given temperature and air flow will be greatly increased. For example, at 300° F. with an air velocity of 500 feet per minute, the drying time of a particle 0.010 inches thick may be from 1 to 2 minutes, while a pulp chip having a thickness of ½ inch may require more than thirty minutes. Because of this extended drying time, the holding capacity of the dryer for chips must be far greater than that of the suspension type dryer processing fine materials, but giving the same rate of evaporation per hour.

A further complication in the drying of chips is in the presence of a small percentage of fine particles which could ordinarily be dried in suspension. While the suspension type dryer provides for the separation of suspended particles in the air at the discharge of the dryer, the major portion of chips supplied consists of particles so heavy as not to be readily air borne and therefore cannot be dried in the stream of air which would otherwise lift the fine particles. The objective of this invention is to provide means for drying a mixture of chips and fine particles without suspending fine particles in the discharge air steam and to provide adequate retention time to complete the drying of relatively heavy particles such as chips.

A principal application of the subject dryer is in the processing of fuel chips as they are fed to a wood burning device using the heat from the combustion gases emerging from the burner as a source of heat for drying the incoming fuel. Thus, a major objective is to maintain drying efficiency at a widely varying rate of input to balance with the burner firing rate.

SUMMARY OF THE INVENTION

As herein illustrated, the dryer comprises means defining an upright enclosure of generally rectangular cross section perpendicular to its length containing openings at the top and bottom and spaced parallel baffle plates which divide the enclosure from bottom to top into three chambers; an intermediate drying chamber and two air chambers, one at each side of the drying chamber. The baffle plates contain a plurality of uniformly-distributed openings and there is means for supplying particulate material to the upper end of the drying chamber through the opening at the top of the enclosure, means for supplying drying air to the chamber at one side of the enclosure at a pressure to cause it to pass through the drying chamber into the chamber at the other side, means for discharging moist air from the chamber at the other side and means for at times oscillating the baffle plates to effect discharge of the particulate material from the lower end of the drying chamber through the bottom opening. The means for supplying air to the chamber at the one side is an inlet opening at the bottom of the chamber at the one side and the means for discharging the moisture-laden air from the chamber at the other side is an outlet opening at the top of the latter chamber. There is means in the inlet opening for preventing entry of particulate material. The baffle plates are inclined to the vertical and there is a distributor plate in the chamber at one side to which the drying air is delivered for diffusion over the entire area of the baffle plate at that side. The openings in the baffle plates are defined by louvers arranged transversely of the side walls and inclined outwardly and upwardly from the inner side and these openings are demensioned to contain the particulate material in the drying chamber, but to permit air to flow freely therethrough. There is means at the top and bottom of the enclosure supporting the baffle plates for reciprocal movement and the means for effecting their reciprocation is a motor-driven oscillator at the top of the enclosure pivotally connected to the respective baffle plates. The lower ends of the baffle plates project into the bottom opening and define means operable by such reciprocation to assist in discharging the dried particulate material. The means for supplying particulate material to the top opening is a feed screw arranged at the top of the enclosure and there is a feed screw arranged below the bottom opening for receiving and transporting dried particulate material away.

In another aspect, the invention resides in a method of drying particulate material comprising supporting a column of particulate material, blowing warm air through the column from one side to the other and from one end to the other and controlling the flow of air to the one side so that the flow from the other side will not produce air-borne particles. The method includes supporting the particles in a column of rectangular cross section perpendicular to its length wherein two of the sides are wider than the other two sides so that the column is wide from side to side and narrow from front to back and wherein the length of the column far exceeds the wider dimensions from side to side, blowing air through the column from back to front and controlling the pressure at the back side so the air flow through the column does not provide air-borne particles. Desirably, the air delivered to the back side is diffused over the entire area to insure uniform pressure from bottom to top.

Figure 2:
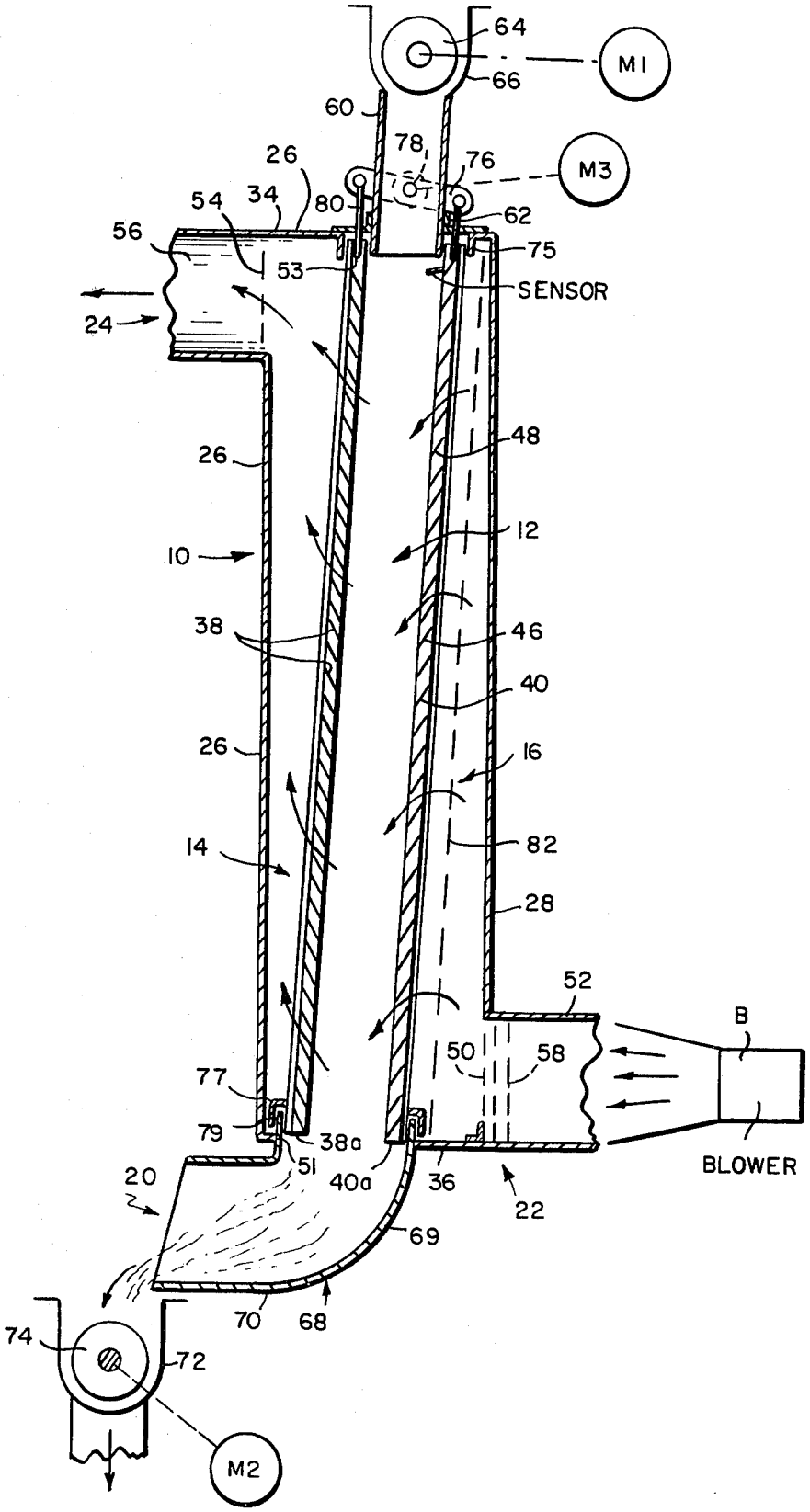

The invention will now be described in greater detail with reference to the accompanying drawings, wherein:

FIG. 1 is an elevation of the rear side of the vertical dryer of this invention; and FIG. 2 is a section taken on the line 2—2 of FIG. 1.

Referring to the drawings, the dryer comprises essentially an enclosure 10, a drying chamber 12 and two air chambers 14 and 16, one at each side of the drying chamber, means 18 for supplying particulate material to be treated to the upper end of the drying chamber 12, means 20 for discharging the dried particulate material from the lower end of the drying chamber, means 22 for supplying drying air to the enclosure and means 24 for discharging moisture-laden air from the enclosure.

The enclosure 10 is vertically elongate and of rectangular horizontal section perpendicular to its vertical axis comprising spaced parallel front and back walls 26 and 28, spaced parallel side walls 30 and 32 and spaced parallel top and bottom walls 34 and 36. The front and back walls 26 and 28 are wider than the side walls 30 and 32 so that the enclosure is narrow from front to back and wide from side to side.

The drying chamber 12 within the enclosure is substantially rectangular in cross section perpendicular to its longitudinal axis and has front and back walls 34 and 36. The front and back walls 34 and 36 are baffle plates corresponding in width to the front and back walls of the enclosure and are reciprocally supported at their upper and lower ends within the enclosure with their opposite longitudinal edges in sliding engagement with the side walls 30, 32 of the enclosure. The baffle plates are spaced from the front and back walls and define in conjunction with the front and back walls the air chambers 14 and 16. Desirably, the baffle plates defining the drying chamber are supported at a slight inclination to the vertical and for reciprocal movement within openings 42 and 44, respectively, at the top and bottom of the enclosure.

The baffle plates 38 and 40 contain a plurality of uniformly-distributed openings 46 which are defined by spaced parallel louvers 48 inclined from the inner side upwardly and outwardly at an angle to contain the particulate material within the drying chamber, but to permit free flow of air through the drying chamber. The angle of inclination of the louvers is approximately 60°.

At the lower end of the enclosure 10, there is an inlet opening 50 to which is connected a conductor 52 through which warm air is supplied to the air chamber 16 and at the upper end there is an opening 54 to which a conductor 56 is connected for discharging moisture-laden air from the air chamber 14. A spark screen 58 is positioned within the inlet opening to make sure that no incandescent particles carried along by the warm air supply enter the chamber 16.

The means 18 for supplying wet particulate material to the upper end of the drying chamber comprises a duct 60 supported with an end extending downwardly into an opening 53 at the top of the enclosure by means of angle members 62-62 and a feed screw 64 operating in a feed trough 66. The means 24 for discharging the particulate material from the lower end of the drying chamber comprising a duct 68 supported with a vertical section 69 thereof extending upwardly into an opening 51 at the lower end of the enclosure and horizontal section 70 which overlies a discharge trough 72 containing a discharge screw 74. Discharge is effected by oscillating the baffle plates constituting the drying chamber, the lower ends of which extend into the vertical portion of the duct 68. The lower edges **38*a* and 40*a* of the respective plates are at right angles to the direction of oscillation and constitute pushers which operate to push the particulate material downwardly through the discharge duct 68**.

To provide for oscillation, the upper ends of the baffle plates are slidably supported between the inwardly projecting sides of the duct 60 at the top of the enclosure and inwardly-projecting flanges 75—75 at the opposite sides of the top opening and at the bottom by flanges 77—77 fixed to the baffle plates in sliding engagement with inwardly-extending sides 79—79 of the vertical portion of the discharge duct 68. Oscillation of the baffle plates are effected by means of a rocker arm 76 pivotally supported on a shaft 78 and provided at its opposite ends with links 80—80 which are connected to the upper ends of the respective baffle plates.

The respective conveyors 64 and 74 are driven by motors M1 and M2 and the shaft is oscillated by a motor M3. A motor-driven blower B supplies the drying air to the duct 52.

The structure as thus described provides a relatively long-standing column of particulate material which, so long as the drying chamber is not oscillated or vibrated, will stand in the drying chamber in the path of the freely-flowing dry air which enters the bottom of the enclosure and leaves through the top, the lower end of the column of particulate material being supported by engagement with the lower end of the vertical portion of the discharge means and by the frictional resistance of the particles of the material to flow freely without the impetus of oscillation and/or vibration.

Critical to the operation of the device is the louver arrangement in which the spacing of the air inlet side of the louvers is such as to provide approximately uniform distribution of the air flow through the particulate mass so that even though the density of permeability of the dry mass may vary, the air flowing to all areas of the drying mass will be substantially equal. Desirably, this controlled air flow may be improved by interposing a distributor or orifice plate 82 in the chamber 16 between the warm air supply and the louvered side wall 40 at that side. A further feature necessary to the operation of the device already mentioned is that inclination of the drying chamber and the spacing is such that the material can slide freely downwardly between the opposing louvers. The inclination of the louvers as herein illustrated is approximately 60° and the spacing is approximately one quarter inch. Since it is characteristic of particulate material to bridge or hang up, preventing uniform and controlled flow downwardly, this is the reason for oscillating or vibrating the drying chamber as heretofore pointed out. Such oscillation can be up and down or lateral.

The rate of discharge of the dried material is controlled by the frequency of the up and down cycling of the louvers, the amplitude of the oscillation and the shape of the discharge duct.

In normal operation, the dryer is maintained full of particulate material and as the dried material is required by a burner, for example, a signal will be sent to a control circuit containing the several motors to start the motor which drives the oscillator which, in turn, oscillates the baffle plates defining the drying chamber and starting the motor which drives the discharge conveyor. This will, in turn, reduce the level of particulate material in the drying chamber, whereupon a full level sensor at the top of the column will call for input of fresh material at the top of the dryer and initiate operation of the conveyor at the top. In this way, the dryer will be directly responsive to the fuel used by the burner. Furthermore, since the heat from the dryer may be supplied from the stack gas resulting from the combustion of the fuel being directly returned to the dryer, the drying rate will be substantially equivalent to the fuel use and heat availability. This will permit a close coupling of the dryer to the burner and achieve maximum efficiency.

A considerable advantage of the proposed design is the ability to process particulate material of a wide range of particle size. One of the difficulties in ordinary dryers is the control of fine particles, which are easily air-borne and must be collected in order to eliminate particulate remission from the device. In this design, careful consideration is given to the air velocity from the discharge louver. By maintaining a discharge velocity of less than 100 feet per minute, the entrainment of small particles is insignificant, thus eliminating the need for further means for controlling the particulates.

It should be understood that the present disclosure is for the purpose of illustation only and includes all modifications or improvements which fall within the scope of the appended claims.

What is claimed is:

1. A dryer for particulate material comprising means defining an upright, rectangular enclosure of rectangular cross section perpendicular to its length wherein two of the spaced, parallel walls are wider than the other two spaced, parallel walls, the wider spaced, parallel walls constituting the front and back walls of the enclosure and the narrower spaced, parallel walls constituting the side walls of the enclosure, means in the back wall at the lower end defining an inlet opening, means in the front wall at the upper end defining a discharge opening, said inlet and outlet openings being longitudinally-spaced, the longitudinal distance between said openings being approximately three times the distance between the front and back walls, means at the upper and lower ends of the enclosure defining top and bottom openings, spaced baffle plates supported in the enclosure with their ends located in said top and bottom openings, said top and bottom openings being laterally offset with the top opening being closer to the back wall than the front wall and the bottom opening being closer to the front wall than the back wall so that the baffle plates slope rearwardly from the bottom to the top defining within the enclosure a chamber at the rear side of the baffle plates which tapers, becoming progressively narrower as it ascends from the lower end to the upper end and the chamber at the front side of the baffle plate which tapers becoming progressively wider as it ascends from the lower end to the upper end, said baffle plates defining a sloping passage for receiving the material to be dried which is of substantially uniform cross section from top to bottom having spaced, parallel, imperforate side walls defined by the sides of the enclosure and spaced, parallel perforate walls defined by the baffle plates and said baffle plates comprising spaced, parallel louvers providing passages from the chamber at the rear side of the baffle plates to the chamber at the front side of the baffle plates, said louvers being inclined downwardly from their outer sides toward their inner sides, means at the lower ends of the baffle plates and the bottom opening supporting the baffle plates for vertical movement within the enclosure, means connected to the upper ends of the baffle plates operable to oscillate the baffle plates vertically within the enclosure, a distributor plate containing a plurality of uniformly distributed openings therein positioned in the rear chamber and spaced from and parallel to the rear baffle plate, a spark screen in the inlet opening and means for supplying drying air to the inlet opening at a pressure to cause the drying air to flow through from the chamber at the rear side of the baffle plates through the passage defined by the baffle plates into the chamber at the front side of the baffle plates and out through the enclosure at the top opening.

2. Apparatus according to claim 1 wherein the openings defined by the louvers are dimensioned to contain the particulate material in the passage defined by the baffle plate, but to permit air to flow freely therethrough.

3. Apparatus according to claim 2 wherein the inclination of the louvers is approximately 60°.

4. Apparatus according to claim 1 wherein the lower end of the baffle plates surfaces perpendicular to their longitudinal movement located within the discharge opening which are operable by movement to force the particulate material through the discharge opening.

* * * * *

UNITED STATES PATENT AND TRADEMARK OFFICE

CERTIFICATE OF CORRECTION

PATENT NO. : 4,258,476

DATED : March 31, 1981

INVENTOR(S) : Robert A. Caughey

It is certified that error appears in the above-identified patent and that said Letters Patent are hereby corrected as shown below:

Column 6, line 38, after "plates" insert --define--

Signed and Sealed this

*Twenty-first* Day of *July 1981*

[SEAL]

*Attest:*

GERALD J. MOSSINGHOFF

*Attesting Officer*

*Commissioner of Patents and Trademarks*